US011060774B2

(12) United States Patent
Pistone et al.

(10) Patent No.: US 11,060,774 B2
(45) Date of Patent: Jul. 13, 2021

(54) APPARATUS AND METHODOLOGY FOR OPENING REFRIGERANT SOURCES WHILE SERVICING AUTOMOTIVE REFRIGERATION SYSTEMS

(71) Applicant: ENERGIZER AUTO. INC., St. Louis, MO (US)

(72) Inventors: Kenneth Alan Pistone, Rowlett, TX (US); Vincent Carrubba, Baldwin, NY (US)

(73) Assignee: Energizer Auto, Inc., St. Louis, MO (US)

( * ) Notice: Subject to any disclaimer, the term of this patent is extended or adjusted under 35 U.S.C. 154(b) by 14 days.

(21) Appl. No.: 16/541,268

(22) Filed: Aug. 15, 2019

(65) Prior Publication Data

US 2019/0368795 A1 Dec. 5, 2019

Related U.S. Application Data

(63) Continuation of application No. 14/588,549, filed on Jan. 2, 2015, now Pat. No. 10,408,514.

(60) Provisional application No. 61/923,075, filed on Jan. 2, 2014.

(51) Int. Cl.
*F25B 45/00* (2006.01)

(52) U.S. Cl.
CPC ..... *F25B 45/00* (2013.01); *F25B 2345/001* (2013.01); *F25B 2345/003* (2013.01); *F25B 2345/006* (2013.01)

(58) Field of Classification Search
CPC ..... F25B 45/00; F25B 2345/003; F25B 2345/006; F25B 2345/001; B60H 1/00585
See application file for complete search history.

(56) References Cited

U.S. PATENT DOCUMENTS

| | | | |
|---|---|---|---|
| 1,420,997 | A | 6/1922 | Freeman |
| 1,666,283 | A | 4/1928 | Farley |
| 1,799,727 | A | 4/1931 | Byars |
| 2,001,233 | A | 5/1935 | Anderberg |
| 2,040,868 | A | 5/1936 | Moody |
| 2,285,569 | A | 6/1942 | Crowley |
| 2,635,623 | A | 4/1953 | Moffett |
| 3,336,936 | A | 8/1967 | Mullins |
| 4,116,245 | A | 9/1978 | Ayers |
| 4,204,559 | A | 5/1980 | Wagner |
| 4,324,270 | A | 4/1982 | Mullins |
| 4,476,892 | A | 10/1984 | Boyce |
| 4,621,505 | A | 11/1986 | Ares et al. |

(Continued)

OTHER PUBLICATIONS

Inter Partes Review of U.S. Pat. No. 7,260,943, Trial No. IPR2016-00441, Filing Date Jan. 15, 2016, Petition (67 pages).

(Continued)

*Primary Examiner* — Frantz F Jules
*Assistant Examiner* — Lionel Nouketcha
(74) *Attorney, Agent, or Firm* — Armstrong Teasdale LLP

(57) ABSTRACT

Apparatus and method for opening refrigerant sources while servicing a refrigeration system are provided by this disclosure. A system may include a fluid source, a device capable of coupling to the fluid source, and a fluid receiving system. The device may include a valve disposed in the body of the apparatus. A portion of the valve being engageable with a refrigerant supply composed of either a self-sealing valve or a penetrable seal.

11 Claims, 13 Drawing Sheets

(56) References Cited

U.S. PATENT DOCUMENTS

| | | | |
|---|---|---|---|
| 4,921,013 | A | 5/1990 | Spalink et al. |
| 5,070,917 | A | 12/1991 | Ferris et al. |
| 5,333,467 | A | 8/1994 | Pearl, II et al. |
| 5,397,100 | A | 3/1995 | Miller |
| 5,582,201 | A | 12/1996 | Lee et al. |
| 5,810,326 | A | 9/1998 | Miller |
| 5,827,050 | A | 10/1998 | Price |
| 5,967,204 | A | 10/1999 | Ferris et al. |
| 6,089,032 | A | 7/2000 | Trachtenberg |
| 6,266,971 | B1 | 7/2001 | Schroder et al. |
| 6,354,100 | B1 | 3/2002 | Spanos et al. |
| 6,360,554 | B1 | 3/2002 | Trachtenberg |
| 6,385,986 | B1 | 5/2002 | Ferris et al. |
| 6,438,970 | B1 | 8/2002 | Ferris et al. |
| 6,442,958 | B1 | 9/2002 | Knowles |
| 6,446,453 | B1 | 9/2002 | Trachtenberg |
| 6,481,221 | B2 | 11/2002 | Ferris et al. |
| D467,941 | S | 12/2002 | Duncan |
| D467,942 | S | 12/2002 | Duncan |
| 6,539,988 | B1 | 4/2003 | Cowan et al. |
| 6,609,385 | B1 | 8/2003 | Ferris et al. |
| 6,648,035 | B1 | 11/2003 | Cowan et al. |
| 6,698,466 | B1 | 3/2004 | Cowan et al. |
| 6,719,003 | B2 | 4/2004 | Schroeder et al. |
| 6,722,141 | B2 | 4/2004 | Ferris et al. |
| 6,796,340 | B1 | 9/2004 | Ferris et al. |
| 6,898,979 | B2 | 5/2005 | Cowan et al. |
| D506,154 | S | 6/2005 | Cowan et al. |
| D511,307 | S | 11/2005 | Cowan et al. |
| 6,978,636 | B2 | 12/2005 | Motush et al. |
| 7,077,171 | B2 | 7/2006 | Carrubba |
| 7,107,781 | B2 | 9/2006 | Quest et al. |
| 7,124,598 | B2 | 10/2006 | Quest et al. |
| 7,260,943 | B2 | 8/2007 | Carrubba et al. |
| 7,275,383 | B2 | 10/2007 | Motush et al. |
| 7,673,497 | B2 | 3/2010 | Quest et al. |
| 8,360,119 | B2 | 1/2013 | Huang et al. |
| 9,709,307 | B2 | 7/2017 | Carrubba et al. |
| 2001/0000276 | A1 | 4/2001 | Knowles |
| 2005/0217285 | A1 | 10/2005 | Carrubba et al. |
| 2005/0268642 | A1 | 12/2005 | Appler et al. |
| 2006/0101839 | A1 | 5/2006 | Motush et al. |
| 2006/0236705 | A1 | 10/2006 | Govekar et al. |
| 2007/0191846 | A1 | 8/2007 | Bruneau et al. |
| 2008/0022701 | A1 | 1/2008 | Carrubba |
| 2008/0060377 | A1 | 3/2008 | Appler et al. |
| 2008/0061259 | A1 | 3/2008 | Reginaldo |
| 2010/0139296 | A1 | 6/2010 | Eggen et al. |
| 2010/0281890 | A1 | 11/2010 | Govekar et al. |
| 2011/0041522 | A1 | 2/2011 | Carrubba |
| 2011/0186160 | A1 | 8/2011 | Danielson et al. |
| 2012/0192576 | A1 | 8/2012 | Carrubba |
| 2012/0324920 | A1* | 12/2012 | Carrubba ..... F25B 45/00 62/77 |
| 2013/0118187 | A1 | 5/2013 | Carrubba |
| 2013/0284767 | A1 | 10/2013 | Strand |
| 2015/0184911 | A1 | 7/2015 | Pistone et al. |
| 2015/0308879 | A1 | 10/2015 | Pistone et al. |
| 2016/0003509 | A1 | 1/2016 | Pistone et al. |
| 2017/0284716 | A1 | 10/2017 | Carrubba et al. |
| 2019/0032977 | A1 | 1/2019 | Carrubba |
| 2019/0186797 | A1 | 6/2019 | Carrubba |

OTHER PUBLICATIONS

Inter Partes Review of U.S. Pat. No. 7,260,943, Trial No. IPR2016-00442, Filing Date Jan. 15, 2016, Petition (67 pages).

* cited by examiner

APPARATUS AND METHODOLOGY FOR OPENING REFRIGERANT SOURCES WHILE SERVICING AUTOMOTIVE REFRIGERATION SYSTEMS

RELATED APPLICATION

This application is a Continuation of application Ser. No. 14/588,549 filed Jan. 2, 2015, which claims the benefit of U.S. Provisional Application Ser. No. 61/923,075, filed Jan. 2, 2014, wherein the entirety of each of said patent applications is incorporated herein by reference.

BACKGROUND OF THE DISCLOSURE

1. Field of the Disclosure

This disclosure relates to systems, methods and apparatus for fluid delivery. In particular, the present disclosure relates to valve systems that access refrigerant sources and the uses thereof for servicing refrigeration systems.

2. Description of the Related Art

Refrigeration systems have been relied upon as a principal source of cooling in a variety of applications. Refrigeration systems are found in, for example, vehicles, commercial buildings and residential buildings. Many refrigeration systems (e.g., air conditioning systems) use a circulating medium (e.g., refrigerant) that absorbs and removes heat from the space to be cooled and subsequently rejects the absorbed heat elsewhere.

Refrigeration systems operate based on principles of the Reversed Carnot Cycle, also known as the Vapor-Compression Refrigerant Cycle. The ability to achieve cooling by compressing and expanding a gaseous refrigerant may depend to some degree on the amount of liquid fluid present in the system. The amount of liquid fluid may directly influence the performance of vapor-compression-refrigeration systems.

Under charging the system of refrigerant may cause the system to not operate at design set points, risking shortened compressor life, poor cooling performance, and ultimately putting the compressor at risk of mechanical failure.

Over charging may cause liquid refrigerant to enter the compressor resulting in damage to the compressor, increased high side pressure putting more load on the compression system resulting in poorer energy efficiency along with increased wear on the compressor, higher pressures also can result in exceeding the refrigerant systems pressure safety limits and increasing compressor operating temperatures, both resulting in the system turning off and affecting overall cooling performance.

Several factors may adversely affect the amount of refrigerant in the system. For example, the refrigeration system may be subject to significant swings in temperature and frequent thermal cycling due to the action of the system itself and the heat produced by power sources (e.g., engines). Under these conditions, joints and fittings may tend to expand and contract, permitting refrigerant to slowly leak out of the system. In another example, the hoses used may be slightly permeable to the refrigerant, which may also permit the refrigerant to slowly leak out of the hoses. Accordingly, maintenance of refrigerant systems may require monitoring the refrigerant level or pressure and periodic re-charging of the refrigerant as indicated.

Typical automotive air conditioners are provided with at least one service port to allow for the monitoring of refrigerant level and addition of refrigerant to the system. U.S. Pat. No. 7,260,943 to Carrubba et al., which is incorporated herein by reference in its entirety, describes various apparatus that may allow measurements of the refrigerant pressure through a service port and to add refrigerant as needed.

The flow of refrigerant from the refrigerant source is typically regulated via a valve. In some instances, the refrigerant source is a can of refrigerant outfitted with a sealed can top (blind cap) that can only be accessed through the piercing of the seal. In this case, a valve is not part of the container and must be added to control the dispensing of the refrigerant. The valve is typically integrated within a servicing device which is threaded or otherwise attached to an outlet at a top end of the container (blind cap). In some instances, the servicing device includes a fixed length piercing member that is advanced as the servicing device is threaded onto the blind cap, piercing a hole in the seal, thereby allowing the pressurized refrigerant to be expelled from the can into the valve.

In certain refrigerant cans, an integrated valve (e.g., a self-sealing valve (SSV)) is provided at an outlet of the container. The SSV may include a spring-loaded piston that is biased to open the can when the piston is depressed and to close the can when the piston is released, thereby controlling the flow of the refrigerant. U.S. Patent Application Publication Nos. 2012/0192579 to Carrubba and 2011/0041522 to Carrubba describes servicing devices and adapters that are used for delivering refrigerant to refrigerant systems, all of which are incorporated herein by reference in their entirety.

These prior art methods and apparatus describe charging devices with an integrated valve for use on refrigerant cans that are equipped with either a blind cap or a SSV. However, there are no charging devices designed to access both types of refrigerant cans. Three inter-related design challenges exist hindering the development of a universal charging device that can open both types of can tops (i.e., blind cap and SSV).

With regard to the first design challenge, the two types of can tops are dimensional different requiring the piercing or plunging member to be of different lengths to open the refrigerant cans. Additionally, during the filling process, the refrigerant cans and can tops experience dimensional variances due to temperature and pressure changes experienced by the refrigerant. These dimensional variances impede the ability to activate the SSV or the blind cap after a positive seal is made between the charging device and the refrigerant can. A positive seal is required so that the refrigerant can contents are not released into the atmosphere.

The second design challenge is creating a component that is able to pierce a blind can top and depress the piston of an SSV while still allowing sufficient refrigerant flow.

The third design challenge is packaging the piercing/plunging component, valves, and seals capable of handling all of the potential dimensional variances in a low cost, simple, hand held package.

Accordingly, there is a need for devices that are able to be used with containers equipped with self-sealing valves and/or penetrable seals.

The present disclosure provides many advantages, which shall become apparent as described below.

SUMMARY

This disclosure relates in part to an apparatus for servicing a refrigeration system, and methods of operating the same.

In an embodiment, the apparatus for servicing a refrigeration system includes an outer housing, a central body, and an actuator. The central body is disposed within the outer housing and includes an internal bore; a first fluid port, a second fluid port, a third fluid port, and a valve. The first fluid port may be in fluid communication with the internal bore and a refrigeration system. The second fluid port may be in fluid communication with the internal bore and a measuring device. The third fluid port may be in fluid communication with the internal bore and a refrigerant supply. The valve is disposed in the internal bore.

A portion of the valve may be engageable with a self-sealing valve of the refrigerant supply such that actuation of the valve during use moves the valve to a) a first position such that the first fluid port communicates with the second fluid port orb) a second position such that movement of the plunger moves the self-sealing valve to an opened position, allowing fluid to communicate between the third fluid port and the first fluid port, and substantially inhibits fluid communication between the refrigeration system and the measuring device.

The actuator being operatively connected to the outer housing and the plunger, and, during use, actuates the valve to the first position or second position. A portion of the valve may be engageable with a sealed can surface (blind cap) such that when during use, the actuator pierces the blind cap seal opening the refrigerant supply allowing refrigerant to pass into the internal bore where it may be regulated by the valve.

This disclosure also relates in part to an apparatus for servicing a refrigeration system that includes a central body and an actuator. The central body includes an internal bore, a first fluid port, a second fluid port, and a valve. The first fluid port may be in fluid communication with the internal bore and a refrigeration system. The second fluid port may be in fluid communication with the internal bore and a refrigerant supply. The valve is disposed in the internal bore.

A portion of the valve may be engageable with a self-sealing valve of the refrigerant supply such that actuation of the valve during use moves the valve to a) a first position such that movement of the plunger moves the self-sealing valve to an opened position, allowing fluid to communicate between the second fluid port and the first fluid port.

The actuator being operatively connected to the central body and the plunger, and, during use, actuates the valve to the first position. A portion of the valve may be engageable with a sealed can surface (blind cap) such that when during use, the actuator pierces the blind cap seal opening the refrigerant supply allowing refrigerant to pass into the internal bore where it may be regulated by the valve.

This disclosure further relates in part to a kit that includes an apparatus and/or devices for servicing refrigeration systems as described herein In further embodiments, additional features may be added to the specific embodiments described herein.

Further objects, features and advantages of the present disclosure will be understood by reference to the following drawings and detailed description.

BRIEF DESCRIPTION OF THE DRAWINGS

The present disclosure will be better understood and other advantages will appear on reading the detailed description of some embodiments taken as non-limiting examples and illustrated by the following drawings.

DETAILED DESCRIPTION OF THE PREFERRED EMBODIMENTS

It is to be understood this disclosure is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise.

As used herein, "coupled" means either a direct connection or an indirect connection (e.g., ore or more intervening connections) between one or more objects or components. The phrase "directly connected" means a direct connection between objects or components such that the objects or components are connected directly to each other so that the object or components operate in a "point of use" manner. As used herein, "fluid" refers to a liquid, gas, vapor, or a mixture thereof.

As used herein "charging" refers to both charging and recharging of a system. Charging a system may include initially filling a unit with fluid. Recharging may refer to adding fluid to a unit that has some fluid in the unit. Recharging may be performed after a portion of the fluid has leaked out of the unit or the pressure/amount of the fluid has dropped below a desirable level. It will be appreciated that charging and recharging are often used interchangeably.

Systems, methods, and apparatus for coupling a refrigerant fluid source having a self-sealing valve and/or integral valve to a refrigerant system or a sealed can top (blind cap) which requires puncturing or piercing are described herein.

The apparatus allows the addition of refrigerant as needed to the refrigeration system, while being capable of opening or closing the self-sealing valve of the refrigerant source or piercing the seal of the refrigerant source. In some embodiments, the apparatus may allow the measurement of refrigerant pressure in a refrigerant system. In some embodiments, the fluid source is pressurized or under vacuum.

Figure 1:
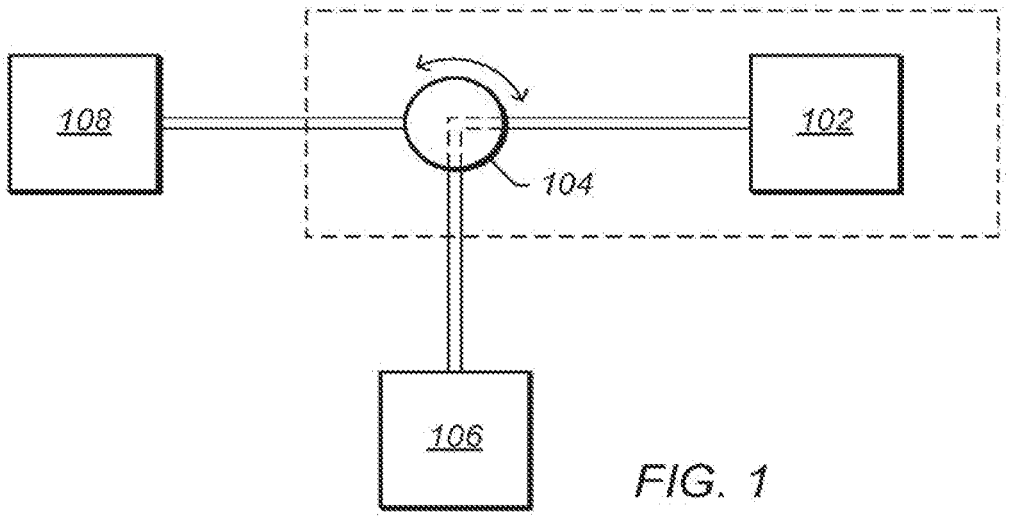
FIG. 1 depicts a schematic of an embodiment of a system for servicing a refrigeration system.

FIG. 1 depicts a schematic of an embodiment of a system for servicing a refrigeration system. The servicing device may include measurement device 102 and switching device 104 for selectively providing communication between receiving system 106, fluid source 108, and the measurement device. The servicing device may be adapted to selectively switch between a charging mode of operation, in which refrigerant from fluid source 108 is provided to receiving system 106, and a measuring mode of operation, in which a parameter of the receiving system is measured by measurement device 102. The depiction of switching device 104 is intended to be illustrative only, and not limiting. Any means for providing the indicated switching may be used in alternative embodiments of the disclosure.

Receiving system 106 may include, but is not limited to, an automobile refrigerant system, a residential refrigerant system, or a commercial refrigeration system, or the like. In some embodiments, receiving system 106 is an automobile refrigerant system. The automobile refrigerant system may include an automobile air-conditioning (A/C) system. In some embodiments, a refrigeration system may include an evaporator, condenser, and compressor that circulates refrigerant to cool or otherwise transfer/remove heat from the respective environment.

Adding of fluid to receiving system 106 may charge or recharge the unit.

Fluid source 108 includes a source of fluid suitable for use in receiving system 106. Fluid source 108 may include a volume of hydrocarbons, halogenated hydrocarbons, or mixtures thereof. In some embodiments, fluid source may include ammonia and/or water. Halogenated hydrocarbons include, but are not limited to, fluorinated hydrocarbons, chlorinated, fluorinated hydrocarbons, fluorinated ethers, 2,3,3,3-tetrafluorprop-1-ene (HF0-1234yf), 1,1,1,2-tetrafluorethane, dichlorodifluoromethane, or mixtures thereof. Commercially available fluid sources include, but are not limited to, HF0-1234yf refrigerants (for example, Genetron@ (Honeywell, USA), Opteon™ (DuPont™ USA), R-134a, R-12, or the like. In some embodiments, fluid source 108 may also include other suitable chemicals including, but not limited to, dyes and/or system lubricants.

Fluid source 108 may be any suitable shape or size and/or may be composed of one or more suitable materials. Fluid source 108 may have a shape that is easily grasped by a human hand, sufficient size to contain a desired volume of fluid; and/or may be composed of a material having sufficient mechanical properties to withstand the static force of a pressurized fluid.

In certain embodiments, fluid source 108 is a portable container. A portable container includes, but is not limited to, a can, a cylinder, or a reservoir that may be easily handled by a user. In some embodiments, fluid source 108 includes, but is not limited to, a stationary reservoir, such as a large tank or similar container. Fluid source 108 may be pressurized or, in some embodiments, under a vacuum. In some embodiments, fluid source 108 is at atmospheric pressure. In an embodiment, fluid source 108 is an aerosol container of R-134a refrigerant or HF01234fy refrigerant. Fluid source 108 may include an integrated valve or a seal that requires puncturing in order to be opened.

The servicing device may be used to determine the level of refrigerant in receiving system 106, and/or add refrigerant to the receiving system from fluid source 108. As shown in FIG. 1, use of the servicing device may be initiated by connecting the servicing device to receiving system 106 and fluid source 108. Switching device 104 may be oriented to provide communication between measurement device 102 and receiving system 106. Measurement device 102 may display one or more parameters of receiving system 106. Switching device 104 may then be oriented to provide communication between receiving system 106 and fluid source 108 to charge the receiving system.

Figure 2:
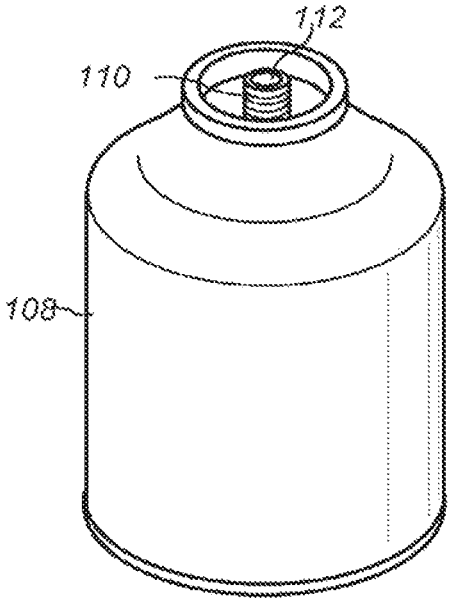
FIG. 2 depicts a perspective view of an embodiment of a fluid source with a penetrable seal.

In some embodiments, fluid source 108 has a penetrable seal. FIG. 2 depicts a perspective view of an embodiment of a fluid source having penetrable seal. Fluid source 108 has, at its top end, an upwardly projecting, externally threaded cylindrical outlet portion 110 with top end wall 112. Top end wall 112 may be pierced and/or punctured. Threaded cylindrical outlet portion 110 may be a ½ inch ACME thread. Threaded cylindrical outlet portion 110 may couple to the servicing device. In some embodiments, the coupling between fluid source threaded cylindrical outlet portion 110 and the fluid port of the servicing device is at least substantially fluid tight. That is, little or no fluid may be allowed to escape through the coupling of threaded cylindrical outlet portion 110 and the fluid port of the servicing device. Threaded cylindrical outlet portion 110 may be permanently or removably coupled to a fluid port of the servicing device.

Figure 3:
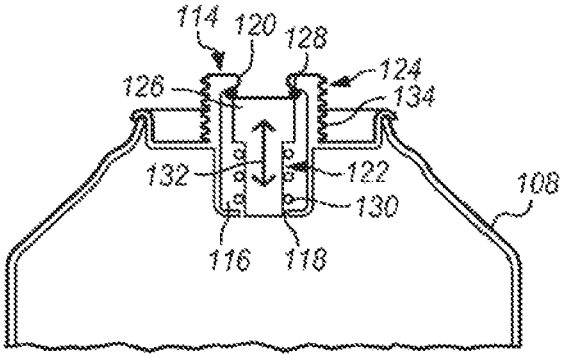
FIG. 3 is depicts a cross-sectional side view of an embodiment of a fluid source with an integrated self-sealing valve.

In some embodiments, fluid source 108 includes an integrated valve having a gating device. FIG. 3 is a cross-sectional side view of an embodiment of a fluid source 108 having an integrated or self-sealing valve. A gating device may include a biased plunger that is movable between an open position (for example, where refrigerant is allowed to exit the fluid source container) and a closed position (for example, where refrigerant is inhibited from exiting the fluid source container). Such an integrated valve may be manipulated to the closed position, the open position, or any position there between to regulate the flow rate and/or pressure of refrigerant being expelled from fluid source 108.

FIG. 3 is a cross-sectional side view of fluid source 108. Fluid source 108 may include fluid source port 114. Fluid source port 114 may function as an inlet and/or an outlet. For example, fluid source port 114 may allow fluid to enter and/or exit fluid source 108. Fluid source port 114 may include bore 116, opening 118, annular lip 120, integrated valve 122, and coupling element 124. Bore 116 may be any suitable shape or size. For example, bore 116 may be at least of sufficient size to receive integrated valve 122. Opening 118 may be any suitable shape or size. For example, opening 118 may be at least of sufficient size to allow pressurized fluid to enter and/or exit fluid source 108 at a desired rate of flow.

Integrated valve 122 may be disposed in bore 116. Integrated valve 122 may be adjustable between an opened position (as referenced herein, an opened position includes any position in which a fluid is allowed to exit or enter fluid source 108) and a closed position (as referenced herein, a closed position includes any position in which a fluid is inhibited from exiting or entering fluid source 108). Integrated valve 122 may be adjusted between the closed position and the opened position to regulate the flow and/or pressure of fluid being transferred to or from fluid source 108.

In some embodiments, integrated valve 122 is a self-sealing valve. In some embodiments, integrated valve 122 includes gating device 126, sealing member 128, and bias member 130. The position of gating device 126 may be manipulated to adjust integrated valve 122 between an opened position and a closed position. For example, gating device 126 may be translated longitudinally as shown by arrow 132. Bias member 130 may urge gating device 126 longitudinally towards annular lip 120. In some embodiments, bias member 130 includes a coiled spring. Gating device 126 may be engaged and/or manipulated by an external device. For example, gating device 126 may be engaged and/or manipulated by a plunger of the servicing device.

In some embodiments, gating device 126 and the external device have complimentary dimensions. Sealing member 128 may be coupled to gating device 126. Integrated valve 122 may be in a closed position when sealing member 128 is pressed against an inside surface of annular lip 120. Sealing member 128 may seal against the inside surface of annular lip 120 such that the unintentional release of fluid from the interior of fluid source is inhibited. Integrated valve 122 may be adjusted to an opened position from the closed position when gating device 126 is translated longitudinally away from annular lip 120. Translating gating device 126 away from annular lip 120 may allow fluid to flow from the interior of fluid source through bore 116 of fluid source port 114.

As fluid source can types become more regulated worldwide, a universal servicing device that may be used to determine the level of refrigerant in the receiving system 106, and/or add refrigerant to the receiving system from the fluid source fluid source, is desired. For example, fluid sources manufactured in California and/or Europe have different can threads and/or types of seals. Currently, an end user must purchase a different servicing device depending on what area of the country or world that the fluid source is to be used. Many of the fluids used worldwide are different chemical compositions which may degrade the seal material. For example, the chemical composition (for example, refrigerant gas and additives) may not include lubricant. Lubricant in the fluid lubricates the seals and extends the life of the seal. If lubricant is not present, other chemicals in the composition may degrade the seal material. Degradation of seal material may cause leakage from the can to the atmosphere or cause improper sealing of the servicing device with the can. As such, improved valves that require minimum seals are desired.

Figure 4:
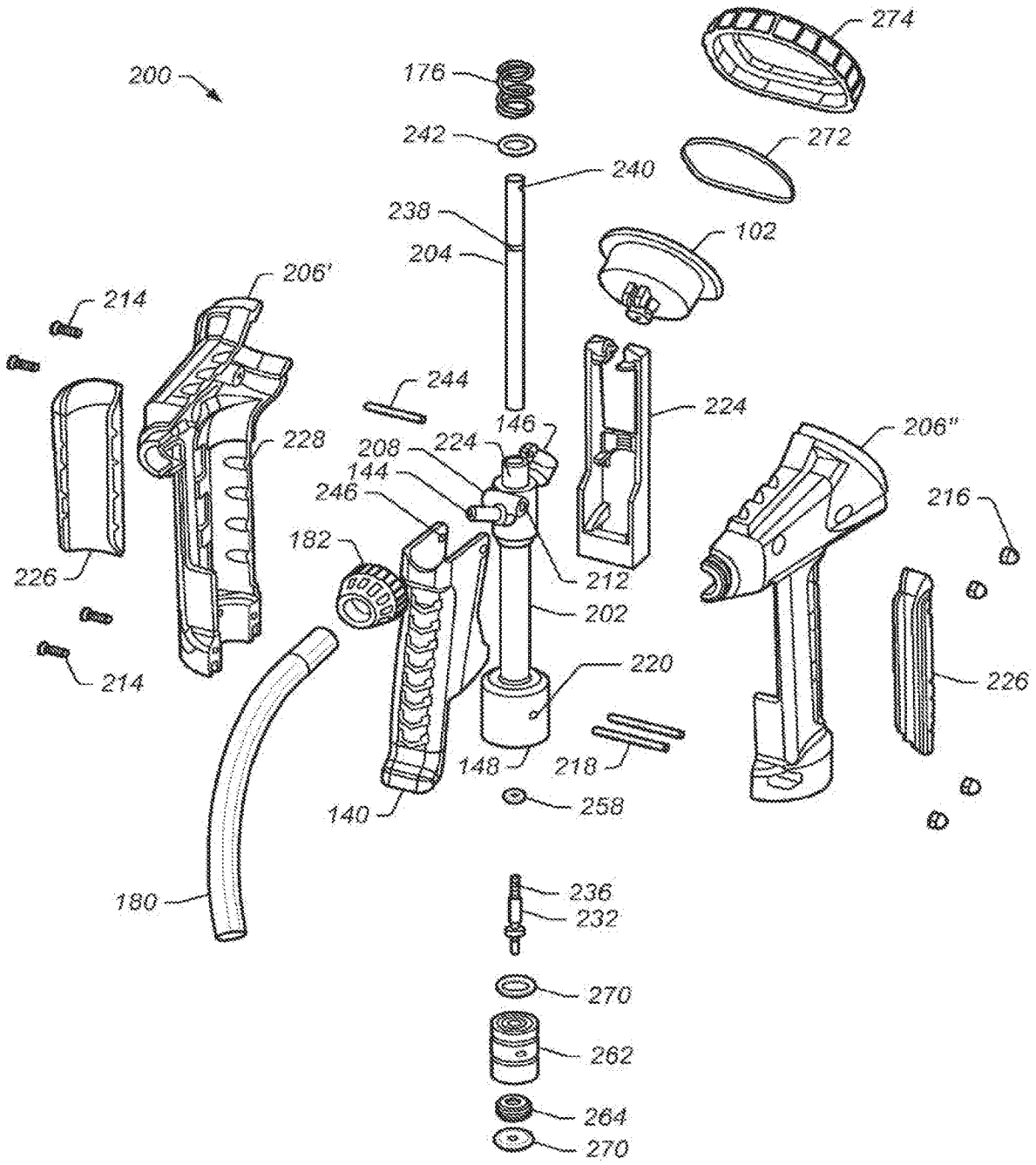
FIG. 4 depicts an exploded view of an embodiment of a universal refrigerant system servicing device.
Figure 5:
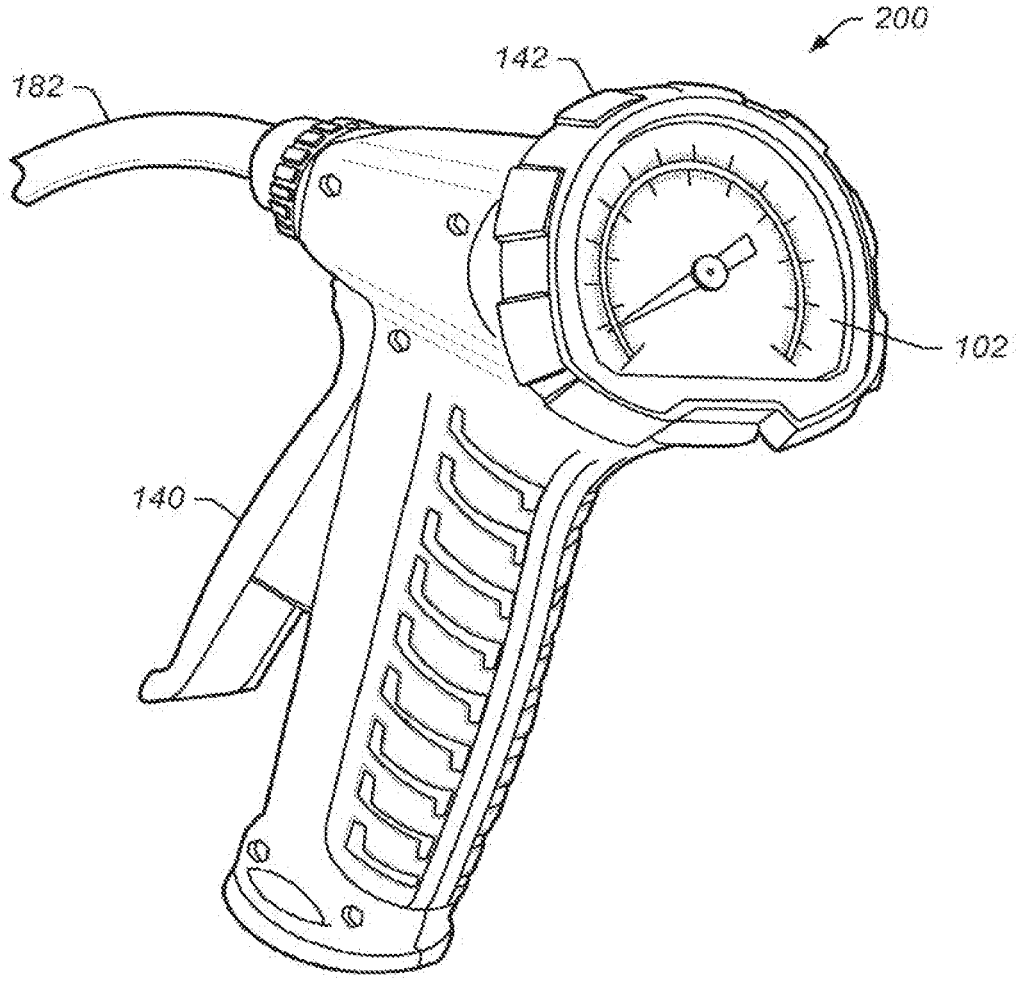
FIG. 5 depicts a perspective side view of the assembled universal refrigerant system servicing device of FIG. 4.
Figure 6:
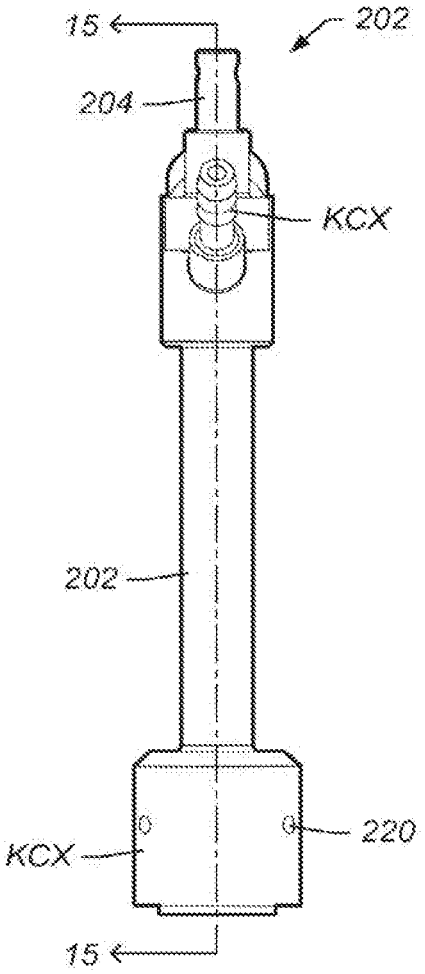
FIG. 6 depicts a perspective side view of an embodiment of a valve of a universal refrigerant system servicing device.
Figure 7:
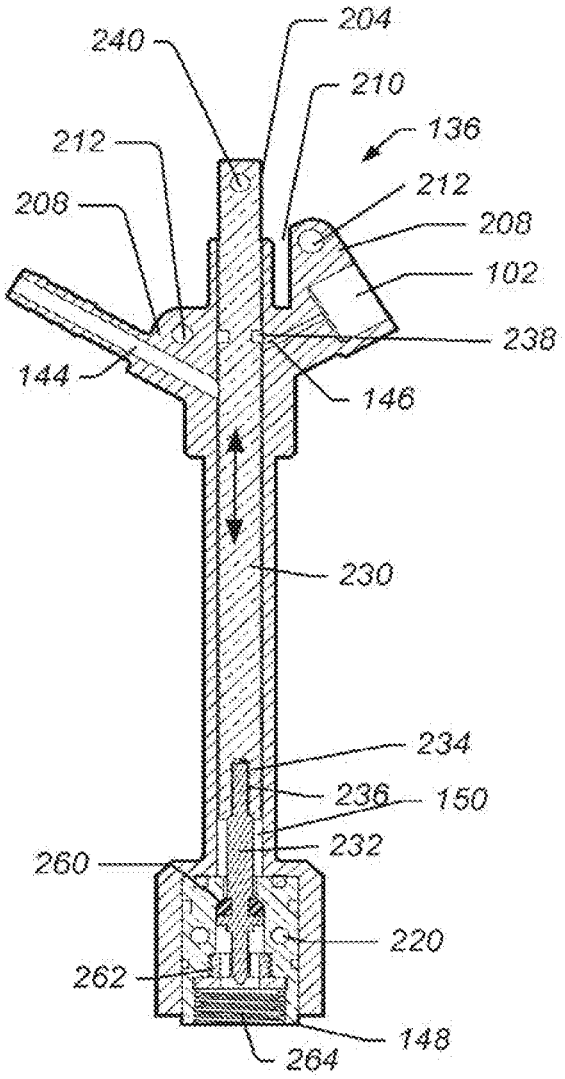
FIG. 7 depicts a cross sectional view of the valve depicted in FIG. 6 along lines 15-15.
Figure 8:
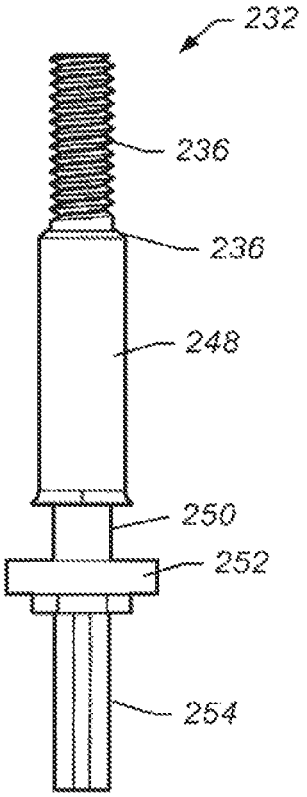
FIG. 8 depicts a perspective side view of a plunger of a universal refrigerant system servicing device.
Figure 9:
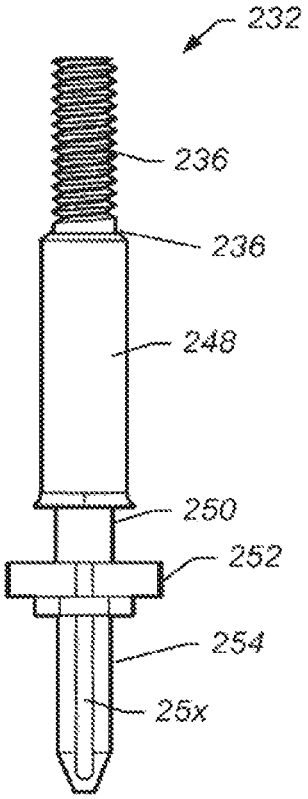
FIG. 9 depicts a perspective side view of a plunger of a universal refrigerant system servicing device having a tapered end.

FIG. 4 depicts an exploded view of an embodiment of a universal refrigerant system servicing device with an improved sealing mechanism. FIG. 5 depicts a perspective side view of the assembled universal refrigerant system servicing device of FIG. 3. FIG. 6 depicts a perspective side view of an embodiment of a valve of a universal refrigerant system servicing device. FIG. 7 depicts a cross sectional view of the valve depicted in FIG. 6 along lines 15-15. FIG. 8 depicts perspective view of a plunger of a universal refrigerant system servicing device. FIG. 9 depicts a perspective view of a plunger of a universal refrigerant system servicing device having a tapered end.

The servicing device may include central body 136, valve 204, valve actuator 140, and housing 206. Central body 136 may include first fluid port 144, second fluid port 146, third fluid port 148, and passage 150 (inner bore). First fluid port 144 may be adapted to connect to fluid receiving system 106, second fluid port 146 may be connected to a measurement device 102, and third fluid port 148 may be adapted to connect to fluid source 108. Central body 136 may be formed of material compatible with the fluid source. For example, central body 136 may be formed of metal, polymeric material and/or combinations thereof. In some embodiments, central body 136 is formed from polymers and molded. Central body 136 may include a middle portion that has an outer diameter less than the upper portion of the central body and a bottom portion of the central portion.

Central body 136 may include coupling members 208 and groove 210 (shown in FIG. 7). Coupling members 208 includes opening 212. Screws 214 is positioned in openings 212 and secures sides 206' and 206" of housing 206 to central body 136. End caps 216 connect to screws 214. Pins 218 insert in openings 220 (See, also FIG. 7) to secure sides 206' and 206" of housing 206 to a bottom portion of central body 136. Central body may be secured in housing 142 by snap fitting, epoxying, or other known methods. Biasing member 176 is positioned in groove 210 and surrounds upper portion 222 of central body 136. A portion of valve 204 may be biased within passage 150 in an upward direction by biasing member 176. Biasing member 176 may be a spring or the like. In some embodiments, a portion of valve 204 may be biased upward, away from the self-sealing valve to inhibit an end of plunger from engaging with the integrated valve or a penetrable seal when the servicing device is coupled to fluid source 108.

Central body 136 may be positioned in bracket 224 which supports measurement device 102. Central body 136 may be snap fitted into bracket 224 and/or secured using known methods in the art (for example, glued or epoxied).

Housing 206 may include grips 226, or the like, to enhance squeezing or gripping by a user. Grips 226 may be formed of rubber and/or polymeric materials. Housing 206 may be manufactured from alloys, aluminum, polymeric materials or combinations thereof. Housing 206 may include dents 228 that accept posts (not shown) of complimentary shape. Dents and posts may enhance coupling and securing of housing sides 206', 206" to each other.

Valve 204 may be slidably disposed in passage 150 of central body 136. Valve 204 may allow selective communication between first fluid port 144 and second fluid port 146, and the first port and third fluid port 148, in response to an actuation of the valve actuator 140. Valve 204 may be adapted to engage a self-sealing valve and/or a complementary plunger of an integrated valve of the fluid source to enable fluid to flow from the fluid source, or a fluid source that includes a top seal that opens by puncturing or piercing. Universal valve 204 allows one servicing device to be used with many types of fluid sources.

Valve 204 and may include body 230 and plunger 232. Valve body 230 may have an outside diameter that is greater than the outside diameter of plunger 232. Internal portion 234 of body 230 may be shaped and configured to accept an end of plunger 232. In some embodiments, internal portion 234 may include female threads that are complementary to coupling member 236 of plunger 232 which allows for the plunger to be removably coupled to body 230. The ability to removably couple plunger 232 to body 230 of valve 204 allows the same servicing device to be used with many types of fluid sources (for example, fluid sources that self-sealing valves or puncture seals). Central body 230 may include groove 238 and hole 240. Sealing member 242 (for example, an O-ring) may be positioned in groove 238. Pin 242 may be positioned through holes 246 of actuator 140 to connect the valve to the actuator. Other coupling methods known in the art may be used to couple valve to actuator 140 (for, example, press-fitted, glued, screwed, epoxied, or the like).

Sealing member 242 may substantially prevent communication between second fluid port 146 and third fluid port 148. Actuation of valve actuator 140 moves sealing member 242 to above and below second fluid port 146, but not past first fluid port 144. When valve actuator 140 is in a released position (for example, not being squeezed) sealing member 242 is above second fluid port 146 communication between the second fluid port and first fluid port 144 established. In this position, system pressure measurement may be obtained by reading measurement device 102. When valve actuator 140 is compressed (squeezed), sealing member moves below second fluid port 146 and the measurement device displays a zero reading (for example, a zero pressure reading).

Plunger 232 includes, coupling member 236, upper body portion 248, middle body portion 250, stop 252, and end 254. Coupling member 236 may have an outer diameter less than an outer diameter of and upper body portion 248 to allow coupling member 236 to be positioned inside of valve body 230. Upper body portion 248 may have an outer diameter greater than middle body portion 250 and an outer diameter less than an outer diameter of stop 252. Sealing member 258 may be positioned around middle body portion 250 (between upper body portion 248 and stop 252). Sealing member 258 inhibits communication between the third fluid port 148 and the other fluid ports by abutting interior shoulder 260 of passage 150 in a lower portion of central body 136 when valve 204 is in a released position. Positioning of the seal in the lower portion of the central body limits exposure of the seal to chemical compositions as the fluid from the fluid source enters passage 150. When valve 204 is in a released position fluid remains in passage 150. Over time, exposure of the seal to the chemical composition may degrade the seal causing the seal to break or not effectively seal the passage 150. Sealing member 258 may be replaced by uncoupling plunger from valve body 230.

Middle body portion 250 abuts stop 252. In some embodiments, stop 252 is a separate section that directly couples middle body portion 250 to plunger end 254. For example, stop 252 may be press-fitted, welded, soldered or glued to middle body portion 250 and to plunger end 254. In some embodiments middle body portion 250 and/or plunger end 254 may insert into stop 252. In some embodiments, middle body portion 250 to plunger end 254, and stop 252 are formed integrally. An outer diameter of stop 252 may be greater that the outer diameter of upper body portion 248 and plunger end 254.

The position of stop 252 allows the stop to contact can adaptor 262 and/or fluid annular lip 120 of integrated valve 122. Contact of stop 252 with fluid annular lip 120 of a self-sealing fluid source may allow plunger end 254 to fully open integrated valve 122 and allow passage of fluid from the fluid source 108 through the servicing device, and then to receiving system 106. Contact of stop 252 with fluid source adapter 262 provides sufficient resistance so that when sufficient force is applied to valve 204 tapered end of plunger 254, or in some embodiments blunt plunger end, pierces a seal of the fluid source.

Referring to FIG. 8, bottom portion 270 of plunger end 254 is flat or substantially flat. In some embodiments, bottom portion 270 is rounded. Bottom portion 270 may be capable of engaging a gating device of integrated valve 122 and/or a plunger of a self-sealing valve of fluid source 108 when the servicing device (for example, housing 142) is coupled to the fluid source. Referring to FIG. 9, bottom portion 270 is beveled, chamfered, or tapered. In some embodiments, bottom portion 270 is fluted to enhance gas passage past the bottom portion and into passage 150. Bottom portion 270 is tapered sufficiently to allow puncture of a top wall (seal) of fluid source when sufficient force is applied to universal valve 204.

Fluid source adapter 262 may be disposed in central body 136 at third fluid port 148 end. Fluid source adapter 262 may include a coupling member that is complementary to a coupling member in central body 136 (for example, threads). Fluid source adapter 262 may include threaded insert 264 for engaging a threaded nozzle of the fluid source. Seals 270 may assist in providing a substantially air tight seal. Fluid source adapter 262 and threaded insert 264 have a central opening that allows plunger 254, when the valve 204 is engaged, to enter and contact the fluid source seal. Fluid source adapter 262 may be complimentary to a coupling member on fluid supply 108. For example, fluid adapter 262 may be a threaded member that is complementary to an ACME thread on a refrigerant can that includes a self-sealing valve and/or an ACME thread on a refrigerant can that includes a penetrable seal.

Referring to FIG. 7, valve 204 may be positioned in passage 150. As valve 204 is moved in passage 150 (shown by double headed arrow), fluid flows from the fluid source through passage 150 to refrigerant system. Selective positioning of valve 204 allows communication between first fluid port 144 and third fluid port 148. As a result, refrigerant from the refrigerant supply may flow through passage 150, through first fluid port 144, and then to refrigeration system 106.

In some embodiments, the servicing device may be coupled to a fluid source. Referring servicing device may include hose 180 and hose fitting 182. Hose 180 may attach to first port 144. First port 144 may include protrusions to allow hose to connect securely to the first port. A second end of hose 180 may be provided with a coupler (not shown) adapted to connect to the receiving system 106. In some embodiments, the coupler may comprise a quick-connect coupler adapted to connect to a low pressure service port of an automobile air conditioner.

During use, the servicing device may be connected to fluid source 108 by threading an insert 264 of the servicing device onto a male thread of the refrigerant supply and connecting hose 180 to a receiving system 106 (for example, an automobile refrigeration system). During connection of the servicing device to fluid source 108 and receiving system 106, actuator (handle) 140 may remain in an extended (released) position.

The servicing device may include valve actuator 140 for selectively applying an actuating force to valve 204. In some embodiments, valve actuator 140 includes grips, grooves or the like to enhance squeezing or gripping by a user.

While coupled to fluid source 108, when valve actuator 140 is actuated (moved towards fluid source 108), the upward bias of biasing member 176 is overcome, and universal valve 204 moves from a first measuring position in passage 150 to a second charging position. Universal valve 204 may be moved downward toward fluid source 108 by applying pressure to actuator 140 (e.g., squeezing the actuator) thereby engaging (depressing) the self-sealing valve of the fluid source into an open position or puncturing the seal of fluid source. Engaging the self-sealing valve of the fluid source (for example, engaging a gating device of an integrated valve) or piercing a seal of a fluid source allows fluid (for example, refrigerant) to flow from fluid source 108 into passage 150 and/or third fluid port 148 and then to one of more outlets.

Release of actuator 140 may allow universal valve 204 to return to its measuring position under the influence of biasing member 176. Release of actuator 140 may disengage universal valve 204 from fluid source 108 and/or move the universal valve out of the penetrable seal.

It is contemplated that other suitable means for providing an actuating force to the universal valve are considered to be within the scope of the present invention. For example, means for actuating the valve with the handle are considered within the scope of the present invention, including, but not limited to, hydraulic, mechanical, or pneumatic members that could be used to link the plunger portion of the valve with the handle. In addition, the valve actuator may be adapted to receive other actuation forces, such as, for example, pulling, rotating, and/or pushing forces.

Figure 10:
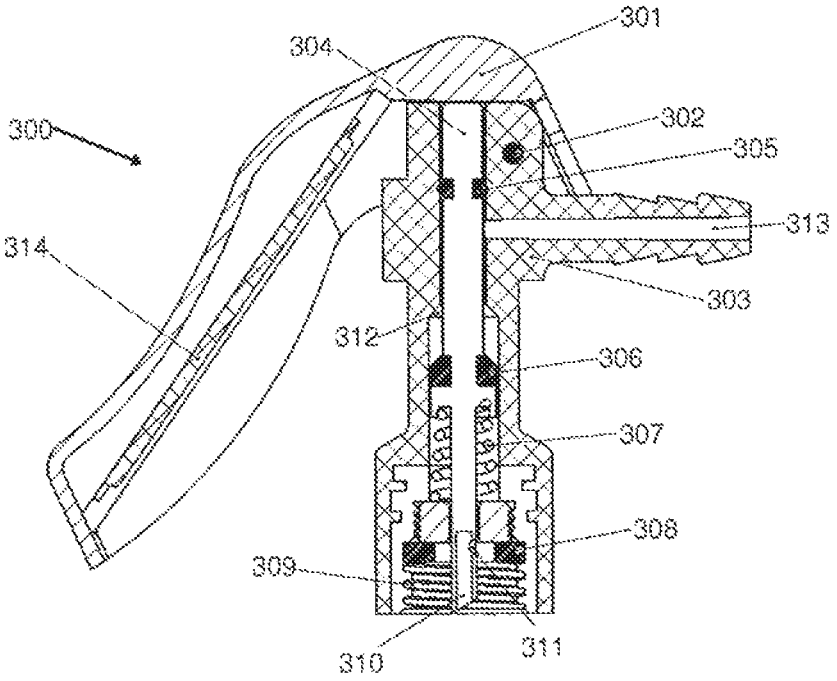
FIG. 10 is a cross sectional side view of an embodiment of a universal servicing device.
Figure 10A:
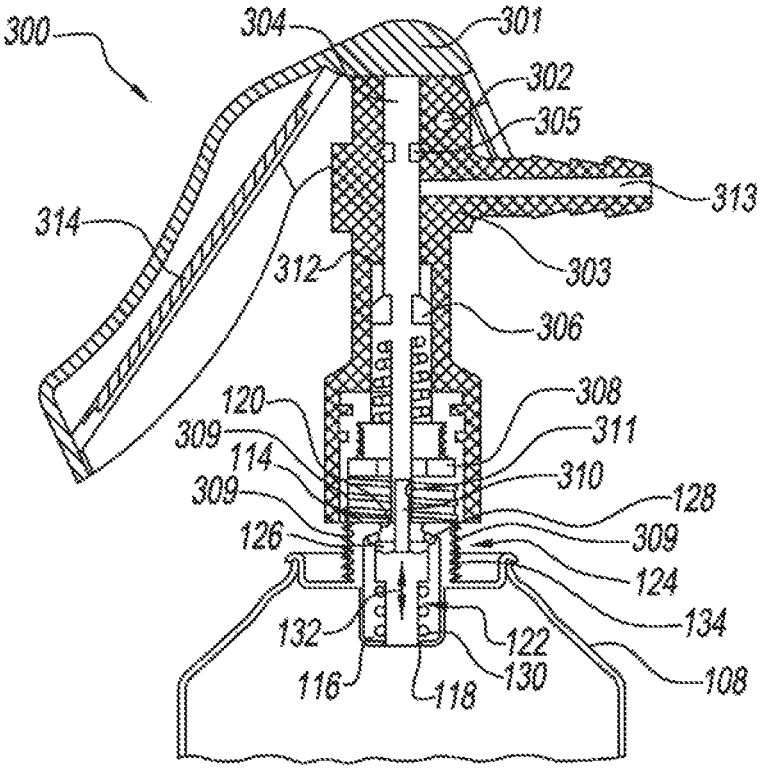
FIG. 10A is a cross sectional side view of the servicing device shown in FIG. 10 affixed to the fluid source with integrated self-sealing valve of FIG. 3.

FIG. 10 depicts a cross-sectional view of servicing device 300. Servicing device 300 may include actuator or lever 301, pivoting pin 302, valve body 303, plunger 304, O-ring seal 305, plunger seal 306, biasing member-spring 307, washer seal 308, can adaptor threads 309, piercing/poking tip of plunger 310, cross bored orifice—fluid communications to first fluid port 311, sealing surface 312, fluid communications to second fluid port 313, and anti-theft security tag 314.

Referring to FIG. 10, the downward traveling plunger with piercing pin 310 opens two types of refrigerant sources. The sources include those which require a seal to be pierced and those that consist of a self-sealing valve which require a pin to be depressed. The downward traveling plunger with piercing pin 310 reduces complexity of the mechanism, thereby reducing the number of components, simplifying assembly, and reducing overall cost. The servicing device 300 allows for self-containment of anti-theft security tags within the handle.

In an embodiment, this disclosure provides a device for servicing a refrigeration system. The device comprises a body having a first fluid port, wherein the first fluid port operatively couples to a fluid source; a plunger, the plunger capable of piercing a seal of the fluid source and/or depressing a valve of the fluid source; a second fluid port, wherein the second fluid port operatively couples to a fluid port of refrigeration system; and a plunger seal at least partially disposed in the passage of the body, the plunger seal is configured to seal the second fluid port during use, wherein the plunger is adjustable between an open and closed position during use. The device also comprises an actuator coupled to the body, and wherein, during use, downward movement of the actuator moves the plunger, opening the valve of the fluid source and/or piercing the seal of the fluid source while simultaneously adjusting the position of the plunger seal to allow fluid communication between the first fluid port and the second fluid port. The fluid source is configured to be hand-held and the downward movement of the actuator is performed by a portion of the hand that is holding the fluid source.

Figure 10B:
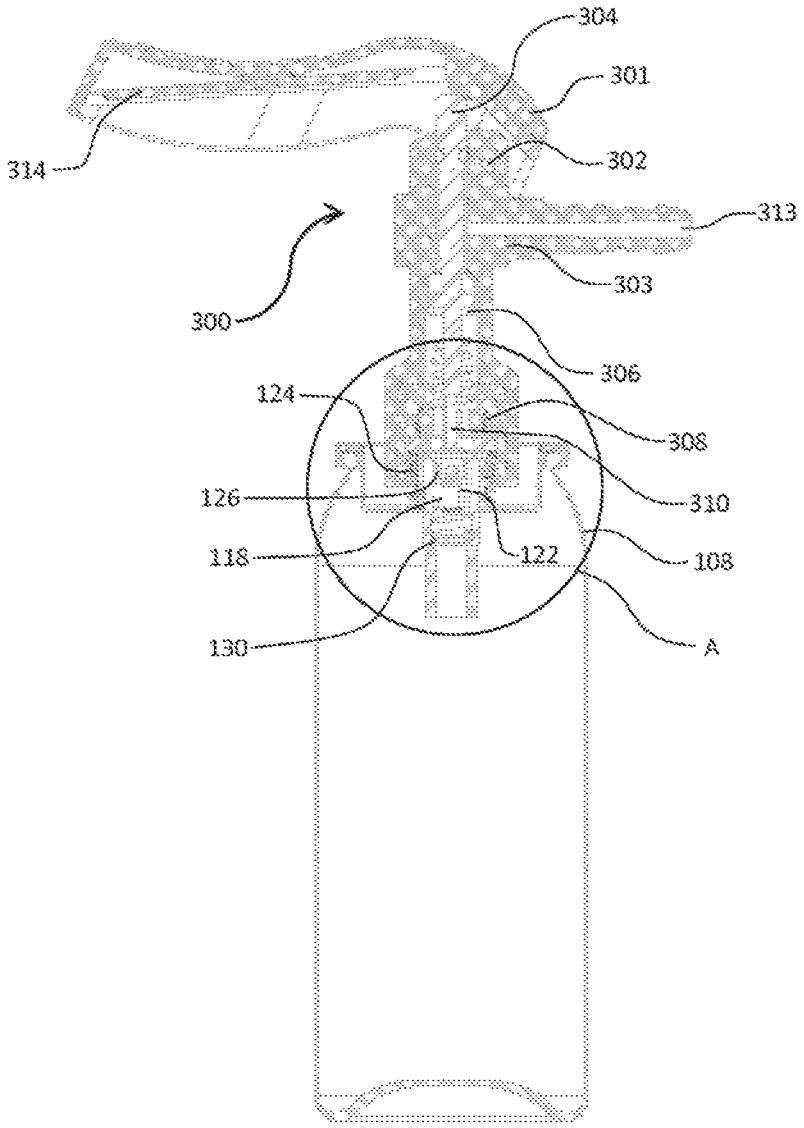
FIG. 10B is a cross sectional side view of the combined servicing device and fluid source of FIG. 10A in the non-activated (i.e. sealed) position.
Figure 10C:
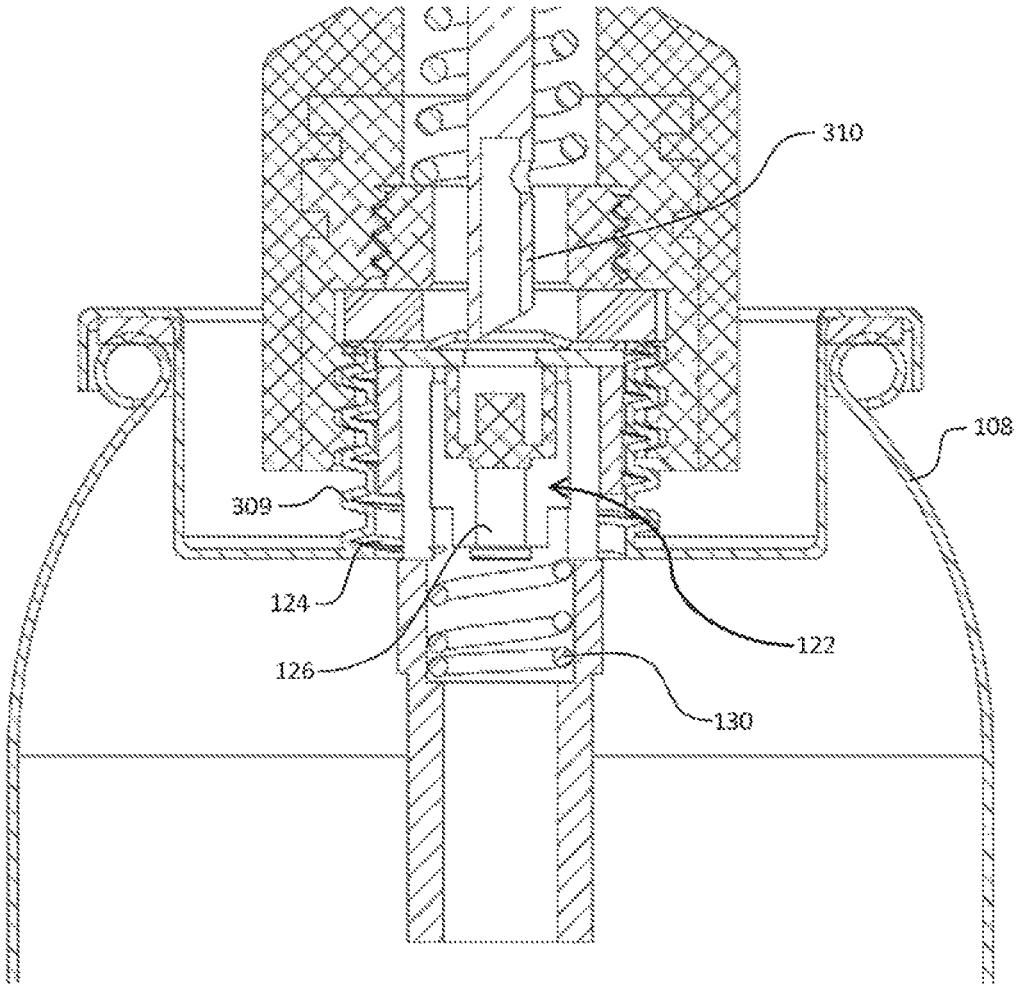
FIG. 10C is an expanded view of insert A from FIG. 10B.
Figure 10D:
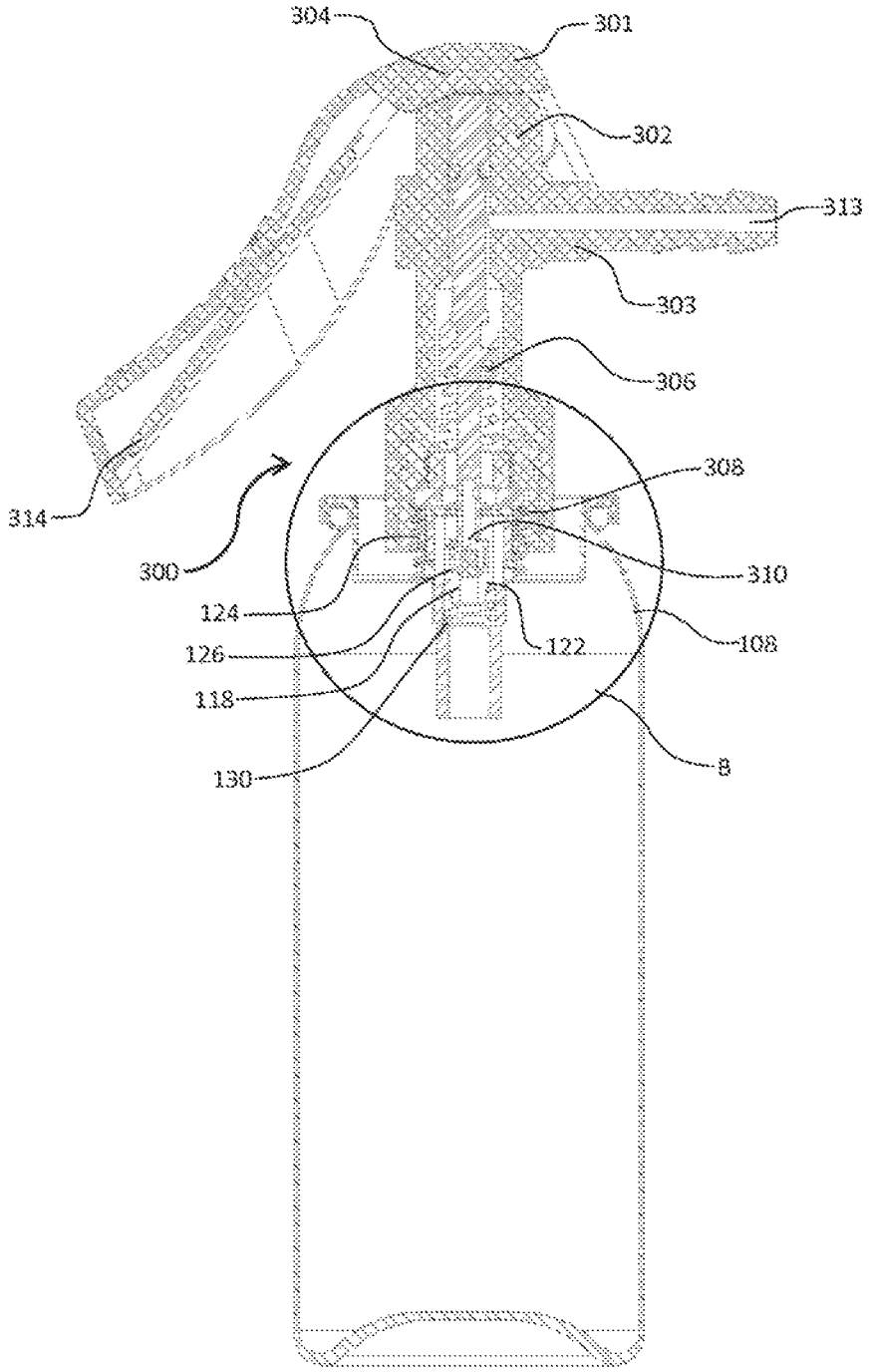
FIG. 10D is a cross sectional side view of the combined servicing device and fluid source of FIG. 10A in the activated (i.e. opened) position.
Figure 10E:
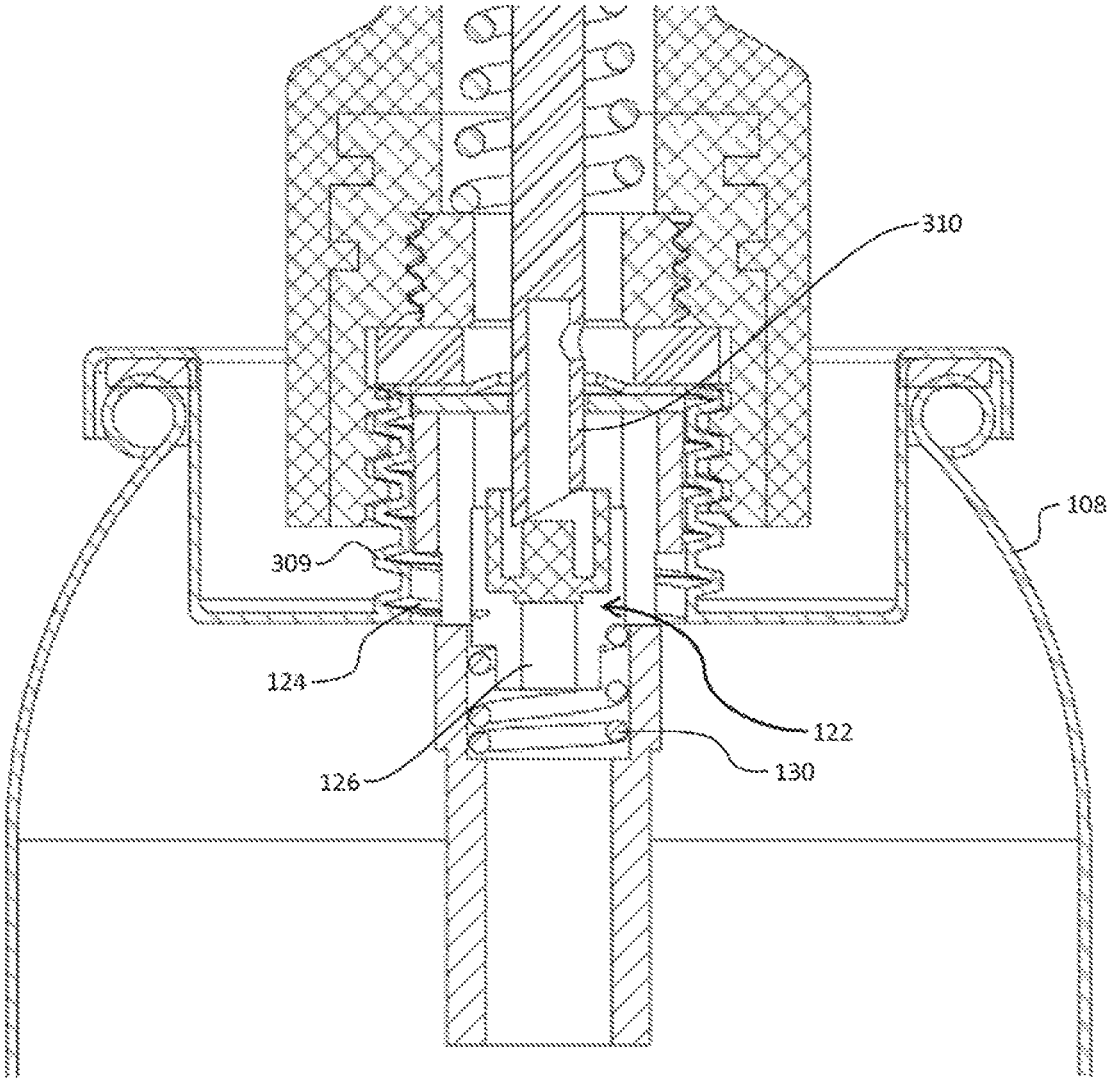
FIG. 10E is an expanded view of insert B from FIG. 10D.

FIGS. 10A-E depict servicing device 300 being connected to fluid source 108 of FIG. 3. This shows when adapter threads 309 are threadably secured to coupling element 124 and how plunger 310 moves integrated valve 122 in a downward direction such that bias member 130 is contracted, thereby allowing fluid to flow between servicing device 300 and fluid source 108 according to one embodiment of the present disclosure. FIGS. 10B-C show the combined servicing device and fluid source in the non-activated (i.e. sealed or closed) position and FIGS. 10D-E show it in the activated (i.e. opened) position.

Figure 11:
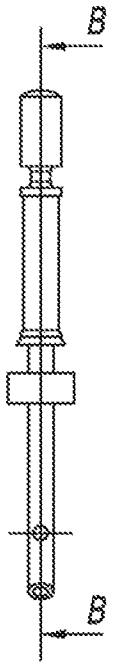
FIG. 11 depicts a perspective side view of a plunger of a universal refrigerant system servicing device of FIG. 10.
Figure 12:
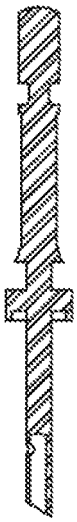
FIG. 12 depicts a cross sectional view of the plunger depicted in FIG. 11 along lines 8-8.

FIG. 11 depicts a perspective side view of a plunger of a universal refrigerant system servicing device. FIG. 12 depicts a cross sectional view of the plunger depicted in FIG. 11 along lines 8-8.

Referring to FIGS. 11 and 12, in the depicted plunger configuration, a sharp cutting tip 310 is positioned at the end of plunger 304. Upon activation of the universal refrigerant system servicing device, the tip 310 penetrates the fluid source seal or depresses a self-sealing valve of the fluid source and is immersed within the fluid source container. The punctured seal or the self-sealing valve opening may be in direct contact with the outside surface of the cutting tip 310. This contact would normally cause a no flow condition as the outside diameter of the plunger would block the newly created opening in the fluid source. A hollow plunger tip with a cross bored hole located on the plunger body 304 at a height sufficiently above the maximum depth by which the plunger penetrates the fluid source allows direct fluid communication between the inside of the fluid source and the first opening of the valve 311. A hollow center and cross bore is one embodiment for eliminating the occlusion of either the self-sealing valve or the pierced seal of the refrigerant source by the outer diameter of the plunger.

The depiction of the housing, the valve actuator, the plunger, the plunger tip, and the valve are intended to be illustrative only, and not limiting. It is appreciated that the size and shape of the housing may vary markedly without departing from the intended scope of the present invention. These and other modifications to the above-described embodiments of the invention may be made without departing from the intended scope of the invention. It will be apparent to those skilled in the art that various other modifications and variations can be made in the construction, configuration, and/or operation of the present invention without departing from the scope or spirit of this disclosure.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of this disclosure as described in the following claims.

While we have shown and described several embodiments in accordance with our disclosure, it is to be clearly understood that the same may be susceptible to numerous changes apparent to one skilled in the art. Therefore, we do not wish to be limited to the details shown and described but intend to show all changes and modifications that come within the scope of the appended claims.

What is claimed is:

1. An apparatus for servicing a refrigeration system, comprising:

a central body, the central body comprising:

an internal bore;

a first fluid port, the first fluid port being in fluid communication with the internal bore and the refrigeration system;

a second fluid port, the second fluid port being in fluid communication with the internal bore and a refrigerant supply device; and a valve disposed in the internal bore, a portion of the valve being engageable with a self-sealing valve of the refrigerant supply device or able to penetrate a seal of the refrigerant supply device, wherein the valve comprises a plunger coupled thereto within the central body, wherein the plunger comprises two openings and a hollow section that extends from a first opening to a second opening to permit fluid flow from the refrigerant supply device through the hollow section of the plunger to the second fluid port of the apparatus; and an actuator, wherein, the actuator is configured to actuate the plunger to move to a first position that allows fluid to communicate between the second fluid port and the first fluid port, or a second position which substantially inhibits fluid communication between the first fluid port and the second fluid port.

2. The apparatus of claim 1, wherein the valve when actuated during use opens the self-sealing valve or punctures the seal of the refrigerant supply device.

3. The apparatus of claim 1, wherein an end portion of the valve is tapered.

4. The apparatus of claim 1, further comprising a biasing member, wherein the biasing member inhibits the valve from contacting the self-sealing valve or the penetrable seal of the refrigerant supply device when the valve is actuated to the second position or is at rest.

5. The apparatus of claim 1, wherein the actuator is a handle capable of being manipulated manually.

6. An apparatus for servicing a refrigeration system, comprising:

a refrigerant supply device having an outlet coupled to a valve;

a first fluid port, the first fluid port being in fluid communication with the apparatus and the refrigeration system; and a second fluid port, the second fluid port being in fluid communication with the apparatus and the refrigerant supply device;

wherein the valve comprises a plunger coupled thereto within a central body, wherein the plunger comprises two openings and a hollow section that extends from a first opening to a second opening to permit fluid flow from the refrigerant supply device through the hollow section of the plunger to the second fluid port of the apparatus, wherein an actuator is configured to actuate the plunger, and wherein the refrigerant supply device outlet comprises either a) a self-sealing valve or b) a seal that requires puncturing, and the means is engageable with the refrigerant supply device outlet.

7. A method of servicing a refrigeration system, comprising:

providing an apparatus to a refrigerant system, the apparatus comprising:

a refrigerant supply device having an outlet, coupled to a valve;

a first fluid port, the first fluid port being in fluid communication with the apparatus and the refrigeration system; and a second fluid port, the second fluid port being in fluid communication with the apparatus and the refrigerant supply device;

wherein the valve comprises a plunger coupled thereto within a central body, wherein the plunger comprises two openings and a hollow section that extends from a first opening to a second opening to permit fluid flow from the refrigerant supply device through the hollow section of the plunger to the second fluid port of the apparatus, wherein an actuator is configured to actuate the plunger, and wherein the refrigerant supply device outlet comprises either a) a self-sealing valve or b) a seal that requires puncturing, and the means is engageable with the refrigerant supply outlet;

advancing the valve of the apparatus such that a first end of the valve punctures the seal of the refrigerant supply device or at least partially opens the self-sealing valve of the refrigerant supply device; and allowing fluid to flow from the refrigerant supply device to the refrigerant system.

8. The method of claim 7, wherein the refrigeration system is an automobile refrigeration system.

9. The method of claim 7, wherein allowing fluid to flow comprises regulating the fluid flow by advancing the valve in an opposite direction to at least partially close the self-sealing valve.

10. The method of claim 7, wherein engaging the plunger of the apparatus into the penetrable seal of the refrigerant supply device comprises applying sufficient force to an actuator coupled to the plunger to puncture the seal of the refrigerant supply device.

11. The method of claim 7, wherein the plunger comprises a tapered end.

* * * * *